US006755716B2

(12) United States Patent
Agostini et al.

(10) Patent No.: US 6,755,716 B2
(45) Date of Patent: Jun. 29, 2004

(54) PROJECTILE SHOOTING TOY

(75) Inventors: Matthew Felix Agostini, Philadelphia, PA (US); William F. M. Dougherty, Oakford, PA (US); Robert Jude Henry, Riverside, NJ (US); Mary Ellen Gertrude Fosbenner, Riverton, NJ (US); Jeremy S. Robotham, Mt. Laurel, NJ (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/696,288

(22) Filed: Oct. 29, 2003

(65) Prior Publication Data

US 2004/0087241 A1 May 6, 2004

Related U.S. Application Data

(60) Provisional application No. 60/423,261, filed on Nov. 1, 2002.

(51) Int. Cl.[7] ..... A63H 17/00

(52) U.S. Cl. ..... 446/435; 446/401; 446/405; 446/473

(58) Field of Search ..... 446/435, 405, 446/407, 400, 401, 473, 456, 454, 45, 7, 175

(56) References Cited

U.S. PATENT DOCUMENTS

| | | | | |
|---|---|---|---|---|
| 2,234,095 A | | 3/1941 | Stout | |
| 2,551,109 A | * | 5/1951 | Fornary | 446/435 |
| 2,701,558 A | | 2/1955 | Murphy | |
| 2,735,221 A | * | 2/1956 | Fields | 446/435 |
| 3,010,718 A | | 11/1961 | Pearson, Jr. | |
| 3,148,478 A | * | 9/1964 | Miller | 446/435 |
| 3,297,325 A | | 1/1967 | Lerner et al. | |
| 3,693,290 A | | 9/1972 | Breslow et al. | |
| 4,114,309 A | | 9/1978 | Gay | |
| 4,219,957 A | | 9/1980 | Kakuta | |
| 4,227,508 A | | 10/1980 | D'Andrade | |
| 4,241,716 A | | 12/1980 | Tsui | |
| 4,604,075 A | | 8/1986 | Richards et al. | |
| 4,659,320 A | * | 4/1987 | Rich et al. | 446/435 |
| 4,728,311 A | | 3/1988 | Magers | |
| 4,925,427 A | | 5/1990 | Wu | |
| 4,981,456 A | * | 1/1991 | Sato et al. | 446/36 |
| 5,069,649 A | | 12/1991 | Wu | |
| 5,295,890 A | * | 3/1994 | Myers | 446/176 |
| 5,306,197 A | | 4/1994 | Watanabe | |
| 5,346,418 A | * | 9/1994 | Arad | 446/91 |
| 5,360,367 A | | 11/1994 | Ho | |
| 5,498,193 A | * | 3/1996 | Locricchio | 446/361 |
| 5,542,872 A | | 8/1996 | Ho | |
| 5,641,317 A | | 6/1997 | Huang | |
| 5,733,169 A | | 3/1998 | Tsai | |
| 5,735,727 A | | 4/1998 | Tsai | |
| 5,766,056 A | * | 6/1998 | Tsai | 446/288 |
| 5,791,967 A | | 8/1998 | Yeh | |
| 5,807,158 A | | 9/1998 | Tsai | |
| 5,810,638 A | | 9/1998 | Wood | |
| 5,816,887 A | * | 10/1998 | Rudell et al. | 446/456 |

(List continued on next page.)

FOREIGN PATENT DOCUMENTS

| | | | | |
|---|---|---|---|---|
| EP | 700703 A2 | * | 3/1996 | A63H/17/00 |

*Primary Examiner*—Derris H. Banks
*Assistant Examiner*—Urszula Cegielnik
(74) *Attorney, Agent, or Firm*—Akin Gump Strauss Hauer & Feld, L.L.P.

(57) ABSTRACT

A projectile shooting toy comprises a body housing, a projectile delivery tube formed with an interior of the housing and a motor driven projectile firing apparatus having a trigger and projectile cannon pivotally mounted to the body housing. Activation of the trigger causes the cannon to move from a stored position to a deployed position, allowing a projectile to enter an inlet of the projectile cannon from the projectile delivery tube. Activation of the trigger further causes a firing ram to abruptly strike the projectile and fire it from the cannon. In a preferred embodiment, the projectile shooting toy is in the form of a helicopter.

18 Claims, 9 Drawing Sheets

U.S. PATENT DOCUMENTS 5,921,843 A * 7/1999 Skrivan et al. ..... 446/433
5,996,564 A 12/1999 Kotowski
6,000,988 A 12/1999 Tsai
6,033,285 A 3/2000 Fine et al.
6,152,801 A 11/2000 Tsai
6,244,463 B1 6/2001 Richards et al.
6,527,619 B1 * 3/2003 Agostini et al. ..... 446/435
2002/0081939 A1 * 6/2002 Hornsby et al. ..... 446/268
2003/0228826 A1 * 12/2003 Dougherty et al. ..... 446/175

* cited by examiner

PROJECTILE SHOOTING TOY

CROSS-REFERENCE TO RELATED APPLICATIONS

This application claims benefit of U.S. Provisional Patent Application No. 60/423,261, "Toy Helicopter", filed Nov. 1, 2002.

BACKGROUND OF THE INVENTION

The present invention relates generally to projectile shooting toys, and more particularly to a projectile shooting toy in the form of a motorized toy helicopter.

Projectile shooting toys are well-known. It is further well known to provide toys generally with motorized moving parts along with parts which may be moved manually. It is also known in the prior art to provide toys with pre-recorded sound effects and operating lights. A projectile shooting toy with a novel firing apparatus which further combines these various features into a single toy should provide particularly engaging play activity.

BRIEF SUMMARY OF THE INVENTION

Briefly, the invention is a projectile shooting toy comprising: a body housing; a drive motor supported by the body housing; an operating trigger having a first unactivated position and a second activated position; and control circuitry operably coupled to the operating trigger and the drive motor wherein the control circuitry activates the drive motor when the operating trigger is moved to the second position. The projectile shooting toy further comprises a projectile firing apparatus, including: a projectile cannon mounted on the body housing and having: a cannon housing having an inlet at a first end and an outlet at a second end, a firing ram operably coupled to the motor, and a projectile retaining flap disposed within the projectile cannon, the projectile retaining flap being movable between a first retaining position and a second release position and being biased into the retaining position by a spring.

In a second aspect, the invention is a projectile shooting toy comprising: a body housing; a drive motor supported by the body housing; control circuitry operably coupled to the drive motor; a first trigger operably coupled to the control circuitry; and a second trigger operably coupled to the control circuitry. The projectile shooting toy further comprises a projectile firing apparatus, including: a projectile cannon mounted on the body housing and having: a cannon housing having an inlet at a first end and an outlet at a second end, and a firing ram operably coupled to the motor. The projectile shooting toy further comprises a movably mounted element and a power transmission operably coupling the drive motor and the movably mounted element. Activation of the first trigger causes the control circuitry to activate the drive motor to move the firing ram from a first position to a second position and then abruptly release the firing ram to return to the first position, thereby striking any projectile held in the cannon housing. Activation of the second trigger causes the power transmission to drive the movably mounted element.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF THE INVENTION

Figure 1:
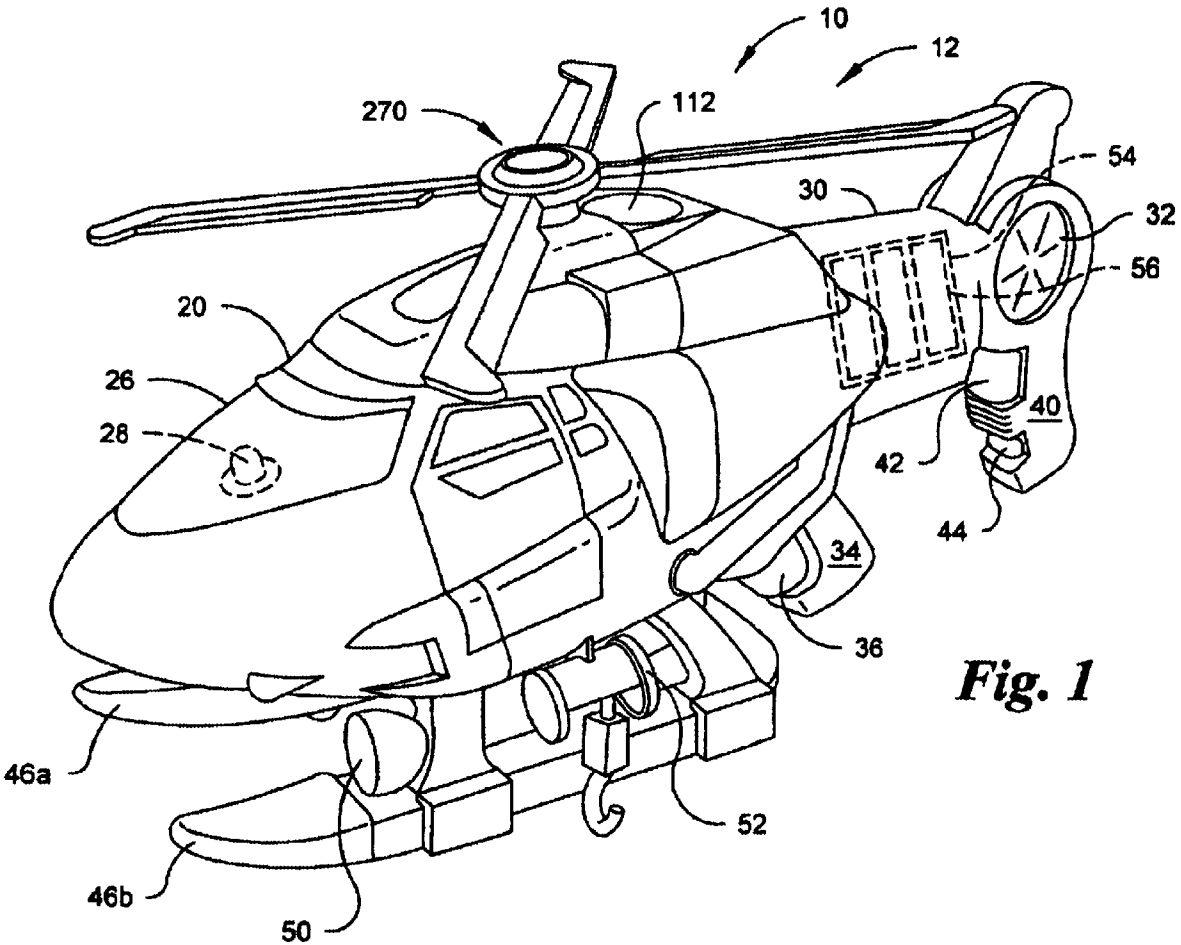
FIG. 1 is a left side perspective view of a projectile firing apparatus in accordance with a preferred embodiment of the present invention.

Certain terminology is used in the following description for convenience only and is not limiting. The words "right", "left", "top", and "bottom" designate directions in the drawings to which reference is made. The words "interior" and "exterior" refer to directions toward and away from, respectively, the geometric center of the projectile shooting toy and designated parts thereof. The terminology includes the words above specifically mentioned, derivatives thereof and words of similar import.

Referring to the figures, wherein like numerals are used to indicate like elements throughout, there is shown in FIGS. 1–9, a preferred embodiment of a projectile firing apparatus, generally designated 10, shown in the form of a toy helicopter 12, in accordance with the present invention.

The toy helicopter 12 has a body housing 20 formed from a right-side body housing 22 and a left-side body housing 24. The body housing 20 includes a cab portion 26 and a tail portion 30. The toy helicopter 12 further includes a spotlight 50, a cockpit light 28, and a manually-operable winch 52. The spotlight 50 and cockpit light 28 are operably connected to a power source 310, preferably conventional dry cell batteries 56 housed in a battery box 54, via control circuitry 300 (see FIG. 9). The artisan will recognize that additional lights could be provided. Furthermore, rechargeable batteries or other types of electric power supplies could be substituted for the dry cell batteries 56. The body housing 20 is supported by a landing assembly 46, including a right portion 46*a* and a left portion 46*b*. Wheels 48 may be included with the landing assembly 46. A first trigger 36 is housed within a first trigger handle 34 extending from the tail portion 30. Second and third operating triggers 42 and 44, respectively, are housed within a second trigger handle 40 also extending from the tail portion 30. Electrical switches (not illustrated) operably couple the triggers 36, 42 and 44 with the control circuitry 300. The battery box 54 is also housed within the tail portion 30, and a removable battery box door covers the power source 310. A speaker 308 (see FIG. 9) is also housed within the tail portion 30 and is covered by a speaker housing 32. The speaker 308 is operably connected to the control circuitry 300.

In this preferred embodiment of the projectile shooting toy 10, the toy helicopter 12 further includes a rotor blade sub-assembly 270. The rotor blade sub-assembly 270 includes a plurality of rotor blades 272 connected to a rotor blade hub 274 and rotor shaft 276 (see FIG. 8). As is discussed later herein, the rotor shaft 276 is operably coupled to a drive motor 210.

Referring now particularly to FIGS. 2–8, the toy helicopter 12 is shown to further include a projectile firing apparatus. The projectile firing apparatus launches a projectile 100, shown to be in a preferred embodiment a ball. Projectiles of other types, shapes and sizes could be substituted and are intended to be included in the invention. As is seen particularly in FIG. 4, the projectile firing apparatus includes a projectile delivery tube 110 disposed within an interior portion of the right body housing 22. The projectile delivery tube 110 includes an inlet 112 and an exit 114. Multiple projectiles 100 may be simultaneously held within the projectile delivery tube 110. In a preferred embodiment, up to three projectiles 100 may simultaneously be held within the projectile delivery tube 110.

Figure 2:
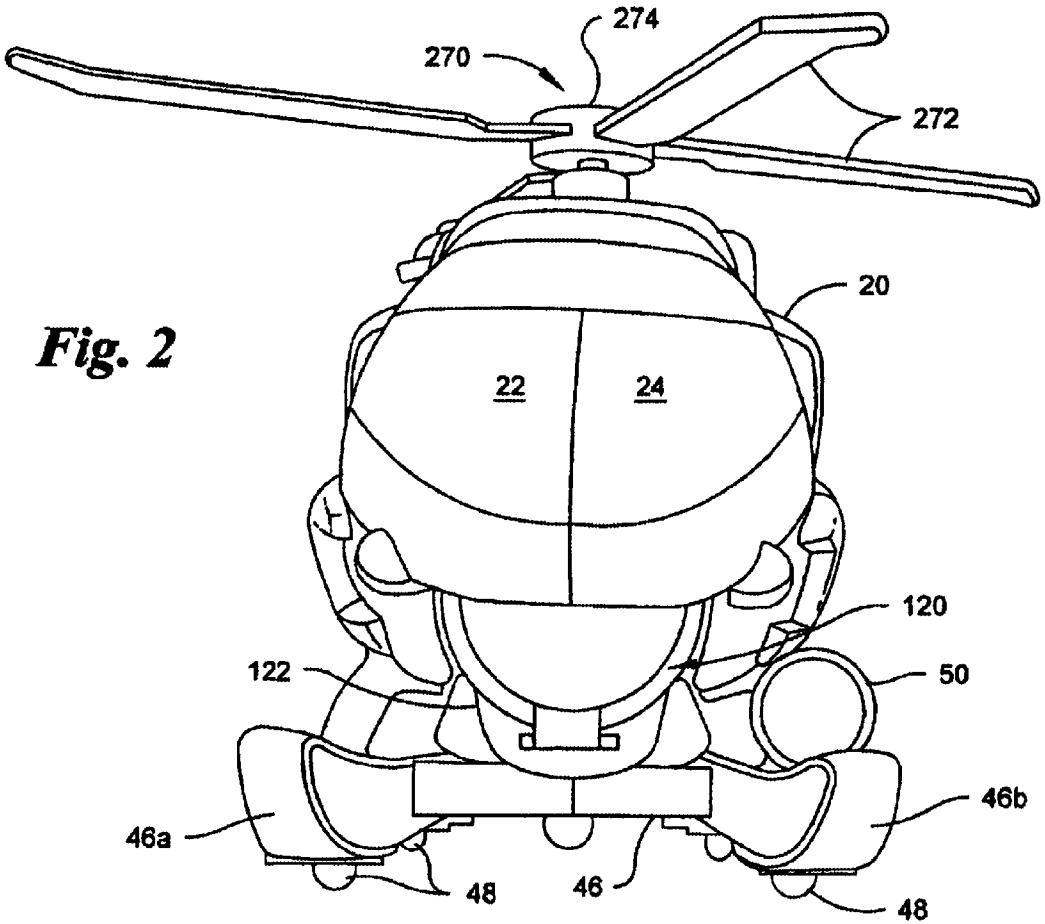
FIG. 2 is a front elevational view of the projectile firing apparatus of FIG. 1 showing a projectile cannon from retracted position.
Figure 3:
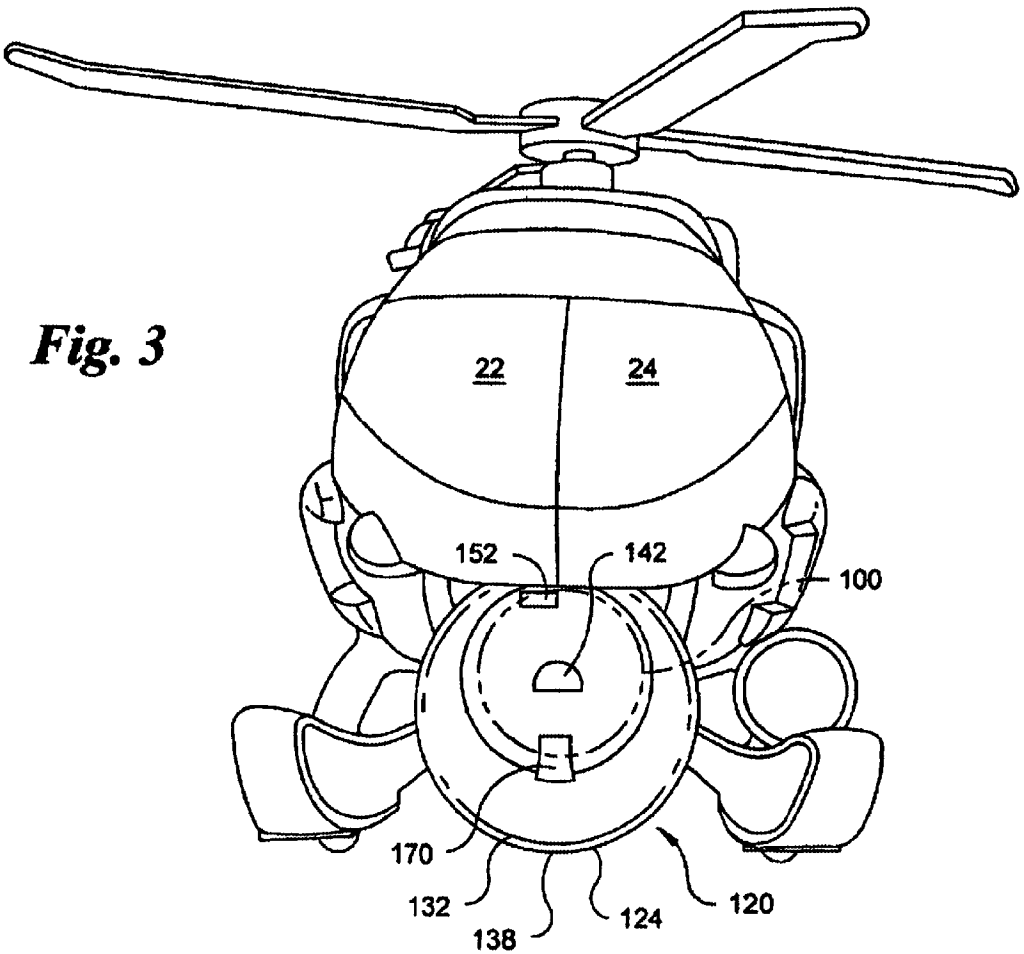
FIG. 3 is a front elevational view of the projectile firing apparatus of FIG. 1 showing the projectile cannon in a deployed position.
Figure 4:
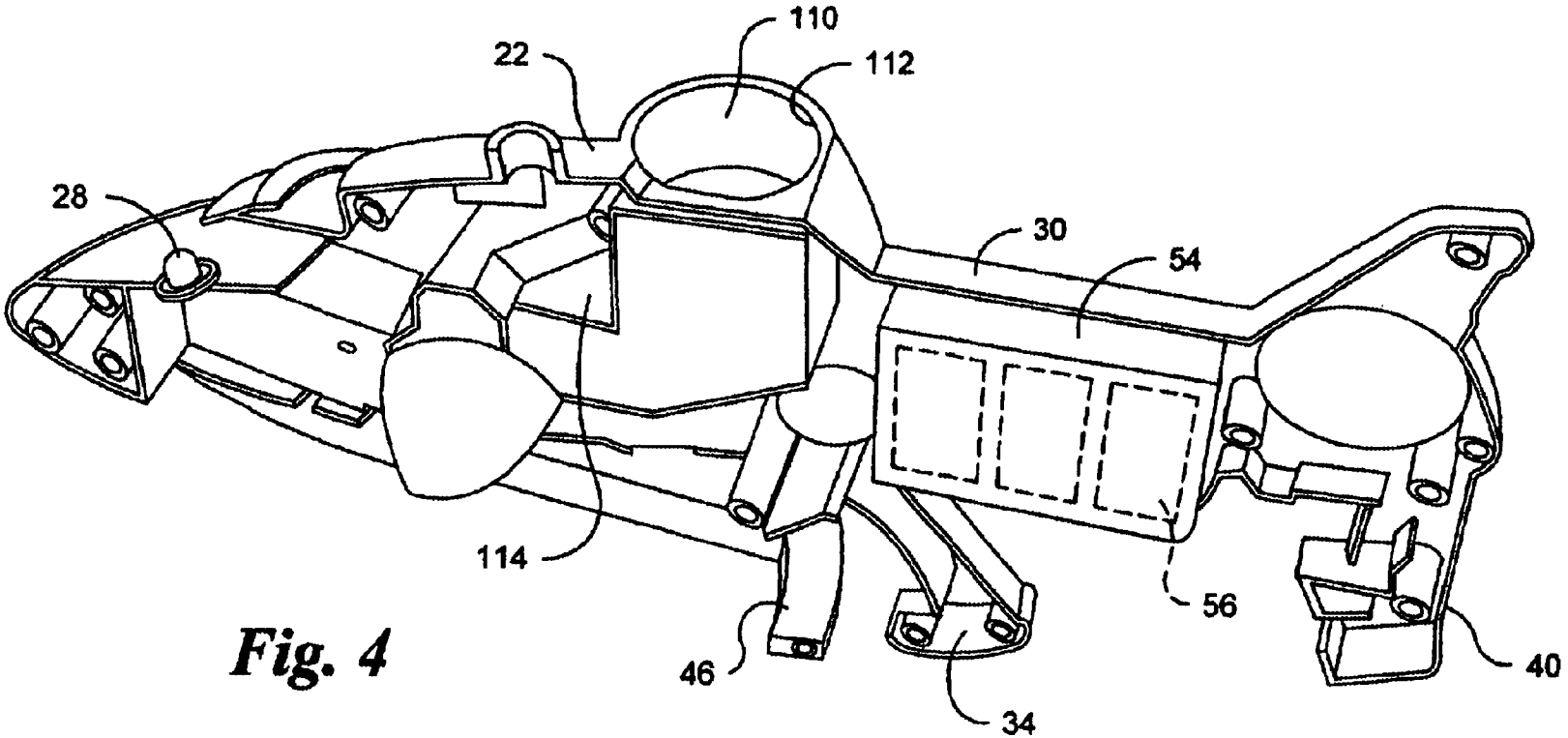
FIG. 4 is an upper side perspective view of an inner side of a right housing of the projectile firing apparatus of FIG. 1.
Figure 5:
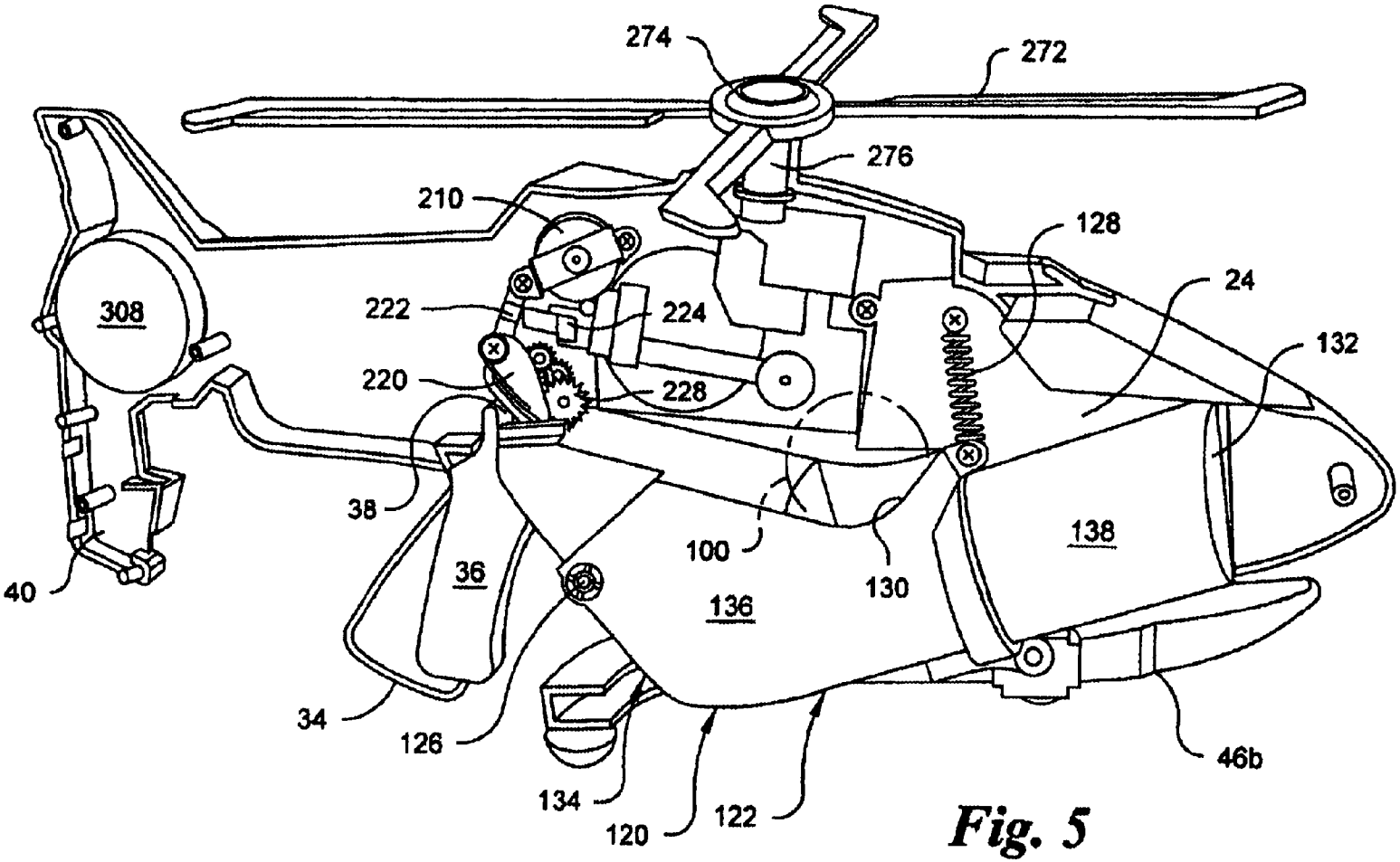
FIG. 5 is a side elevational view of an inner side of a left housing of the projectile firing apparatus of FIG. 1.

Referring now particularly to FIGS. 2, 3 and 5, a cannon sub-assembly 120 of the projectile firing apparatus is shown. FIG. 2 illustrates the cannon 120 in a first position 122, wherein the cannon 120 is stored at least partially within the body housing 20. FIG. 3 illustrates the cannon 120 in a second position 124, wherein the cannon 120 is deployed for firing the projectile 100. With reference to FIG. 5, in moving from the first position 122 to the second position 124, the cannon 120 pivots about a pivot connection 126. The cannon 120 is biased into the first position 122 by a spring 128. The mechanism by which the cannon 120 is moved between the first and second positions 122 and 124 is described later herein. The cannon 120 includes an entry housing portion 134, including a housing cover 136, along with a cannon tube portion 138. The entry housing portion 134 has an inlet 130, while an outlet 132 is disposed at the end of the cannon tube portion 138.

Figure 6:
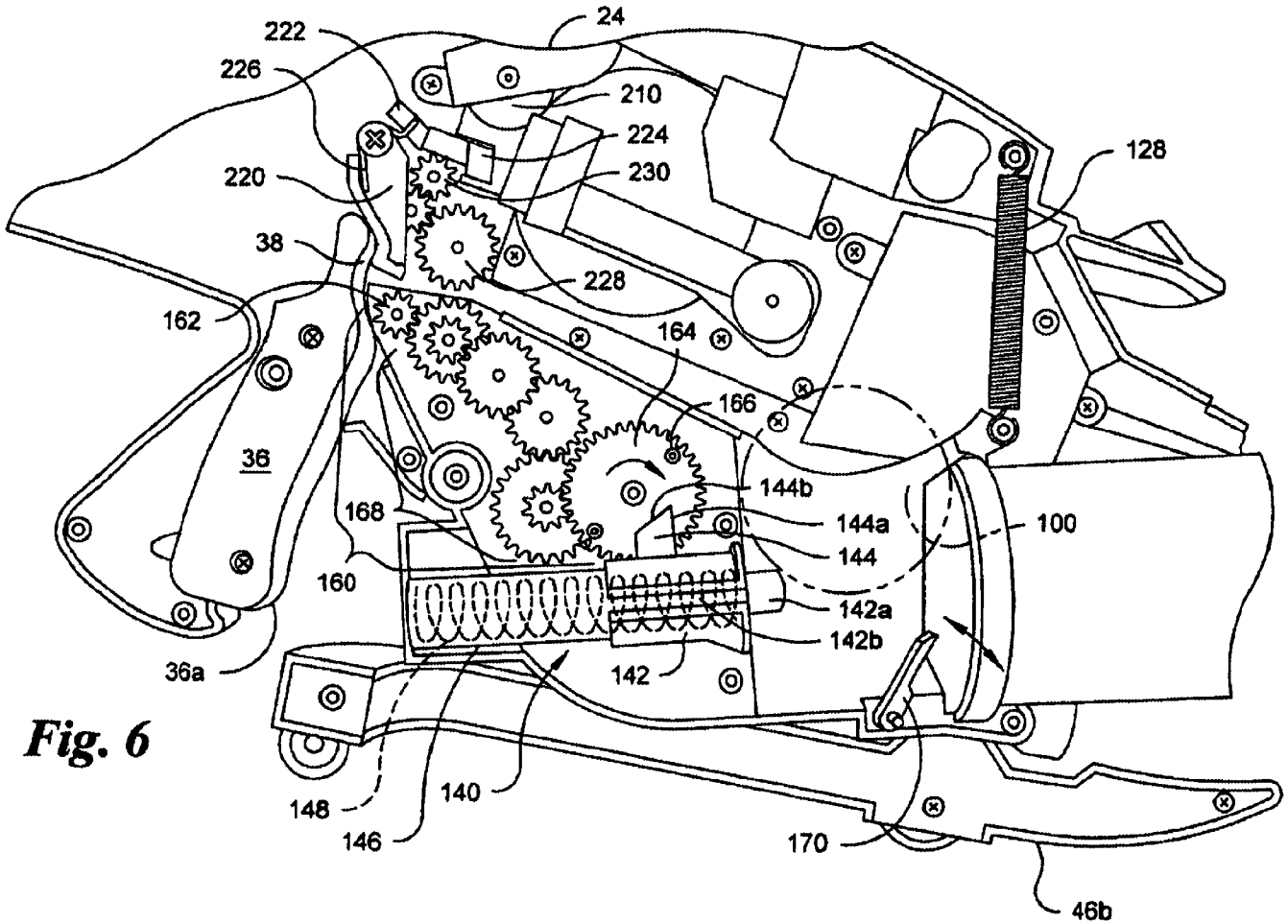
FIG. 6 is a partial side elevational view of the left housing of FIG. 5 in a state of partial disassembly showing portions of a firing apparatus.

With reference now to FIG. 6 the left body housing 24 is shown partially disassembled with the housing cover 136 removed, to illustrate a firing ram assembly 140 along with a firing ram gear drive assembly 160. A firing ram 142 includes a forward portion 142*a* which in operation strikes the projectile 100 to fire the projectile 100 from the cannon 120 as the firing ram 142 moves horizontally from right to left and back (as seen in FIG. 6) during the firing process. The firing ram 142 is hollow and open at an end opposite the forward portion 142*a* A firing ram sleeve 146 is slidingly received within the firing ram 142. The sleeve 146 is open at one end and closed at the opposite end. The open end of the sleeve 146 installs in the open end of the firing ram 142. A firing ram spring 148, shown in phantom in FIG. 6, fits within the sleeve 146 and the firing ram 142 and biases the combination of the firing ram 142 and the sleeve 146 into an extended position, as shown in FIG. 6. The firing ram 142 further includes two linear guide tracks 142*b*, one of which is shown in FIG. 6. The linear guide tracks 142*b*, in conjunction with linear guides, one of which, linear guide 136*a* is described below and illustrated in FIG. 7, maintain proper alignment of the firing ram 142 as the firing ram 142 translates during the firing process.

When the firing ram 142 is in the extended position, the projectile 100 is prevented from dropping into a firing position in front of the firing ram 142. As the firing ram 142 retracts, the projectile 100 has sufficient clearance to drop into the firing position.

A projectile retainer flap 170 is disposed within the cannon 120 and is constantly biased by a spring (not shown) into an upwardly extending position. The projectile retainer flap 170 thus prevents a first projectile 100, which has moved to the firing position, from escaping through the cannon tube 138 (for example, under the action of gravity) before being forced out of the cannon tube 138 under action of the firing ram 142.

Figure 7:
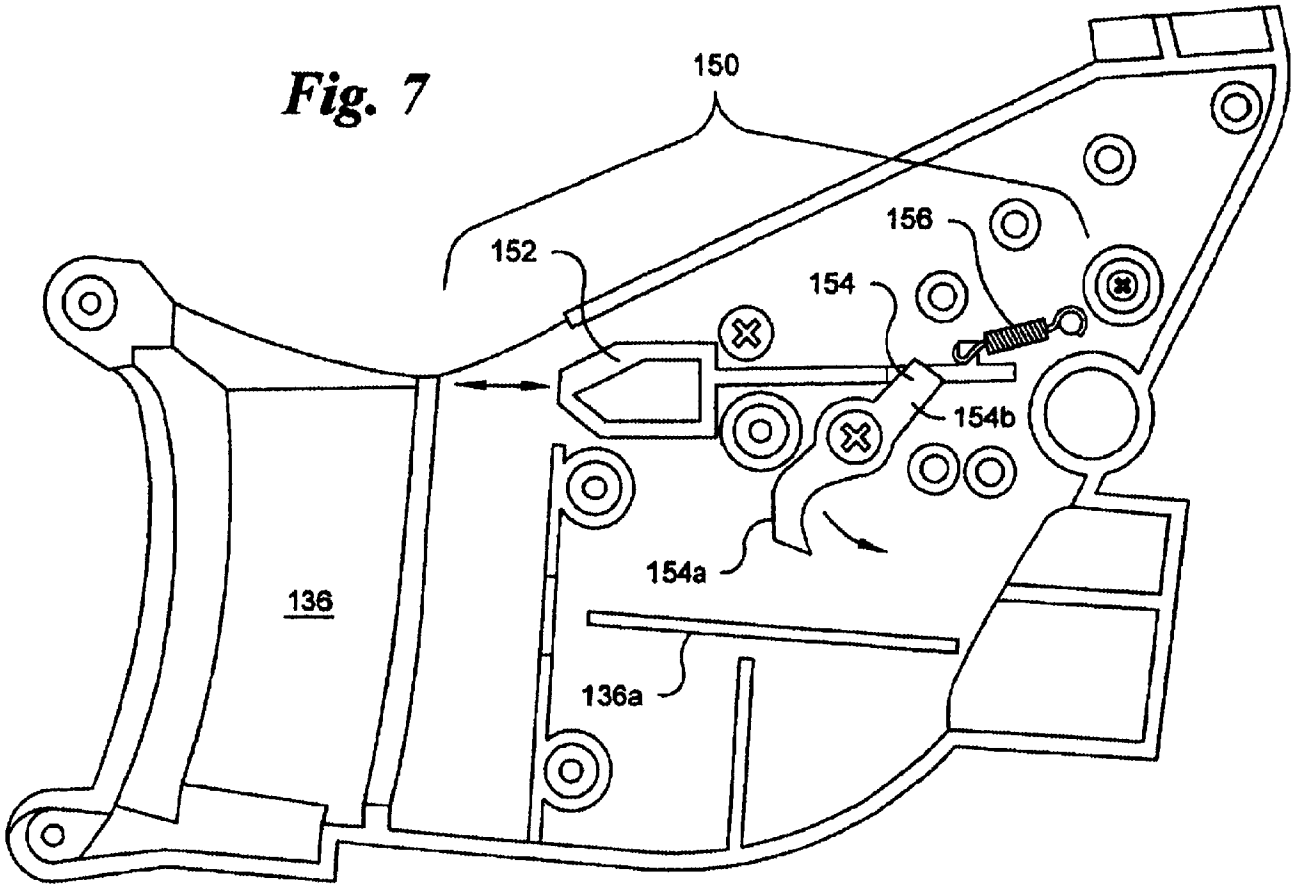
FIG. 7 is a side elevation view of an interior side of a housing cover removed from the left housing of FIG. 6.

FIG. 7 illustrates an interior side of the cannon housing cover 136 removed from the cannon 120 in the illustration of FIG. 6. When the housing cover 136 is assembled with the remainder of the cannon 120 shown in FIG. 6, a number of the components shown in FIG. 7 are operatively engaged with components of the firing ram assembly shown in FIG. 6. Specifically, as indicated above, the linear guide 136*a*, which is integrally formed with a remainder of the housing cover 136, fits within one of the guide tracks 142*b*, to maintain proper alignment of the firing ram 142 during the firing process. A similar linear guide, not illustrated, formed in the left body housing 24, cooperates similarly with the second guide track 142*b*, also not illustrated.

With reference again to FIG. 6, the firing ram 142 has an arm 144 extending upwards therefrom. The arm 144 has a generally vertical front edge 144*a* and an angled upper edge 144*b*. As described below herein in greater detail, during the firing process, a pin 166 extending from a side of a firing ram drive gear 164 rotates into engagement with the front edge 144*a* to pull the firing ram 142 back against the spring 148. As the output drive gear 164 continues to rotate, the pin 166 moves out of engagement with the front edge 144*a*, releasing the firing ram 142 to move abruptly forward and strike the projectile 100.

With reference to both FIGS. 6 and 7, concurrent with the movement of the firing ram 142 under the action of the pin 166 engaged with the front edge 144*a*, the upper edge 144*b* engages a lower end 154*a* of a loading ram lever 154. The loading ram lever 154 is pivotally mounted to the housing cover 136, as shown in FIG. 7. The loading ram lever 154 is one element of a loading ram assembly 150. The loading ram assembly 150 further includes a loading ram 152, which, like the firing ram 142, translates during the firing process. The loading ram 152 and the firing ram 142 move in concert, but in opposite directions. As the firing ram 142 is being pulled back against the spring 148 (to the left from the right in FIG. 6), the loading ram 152 is being pushed forward (to the right from the left if the cover housing 136 were assembled with the remainder of the cannon 120 in FIG. 6). The loading ram 152 operates to prevent a projectile 100 disposed at the cannon inlet 130 from dropping into the firing position during the firing process. More particularly, during the firing process, the upper edge 144*b* of the firing ram arm 144 engages the lower end 154*a* of the loading ram lever 154. As the loading ram lever 154 rotates (counterclockwise as seen in FIG. 7), an upper end 154*b* of the lever 154 engages a portion of the loading ram 152, pushing the loading ram 152 forward against the force of a spring 156, moving the loading ram 152 into a position to block premature entry of a projectile 100 poised to enter the cannon 120 after the projectile 100 then in firing position is fired from the cannon 120. As the firing ram 142 moves forward to strike the projectile 100 in firing position, the upper edge 144*b* moves out of engagement with the lever 154, allowing the loading ram 152 to be pulled back into its nominal position by the spring 156.

With reference again to FIGS. 5 and 6, the cannon 120 is shown in the first position 122 and the first trigger 36 is shown in an unactivated position 36*a* To fire the projectile 100, the first trigger 36 is pulled rearwardly to an activated position (not illustrated). As the first trigger 36 is pulled, the cannon 120 is pivoted from the first position 122 into the second position 124 as a cammed surface 38 (see FIG. 5) engages an upper corner of the cannon 120 to pivot the cannon 120 about pivot connection 126 against the force of spring 128.

With the cannon 120 in the second position 124 (FIG. 3), the cannon inlet 130 becomes positioned relative to the projectile delivery tube exit 114 such that a projectile 100 position at the delivery tube exit 114 can pass through the cannon inlet 130. When the cannon 120 is in the first position 122, the cannon inlet 130 is positioned relative to the delivery tube exit 114 such that a projectile 100 does not have sufficient space to pass through the delivery tube exit 114 into the cannon inlet 130.

FIG. 6 further illustrates a firing ram gear drive assembly 160. The firing ram gear drive assembly 160 includes a firing ram input gear 162 which is operatively connected to the firing ram drive gear 164 described above by a firing ram drive gear train 168.

FIG. 6 still further illustrates first, second and third levers 220, 222 and 224 and a series of gears including a first movable gear 230 and a firing ram upper output gear 228. First movable gear 230 mounts to a first end of a first movable shaft 232 (see FIG. 8). When the cannon 120 is moved into the second position 124 by movement of the first trigger 36 to the activated position (not illustrated), the firing ram input gear 162 is moved into engagement with the firing ram upper output gear 228.

Figure 8:
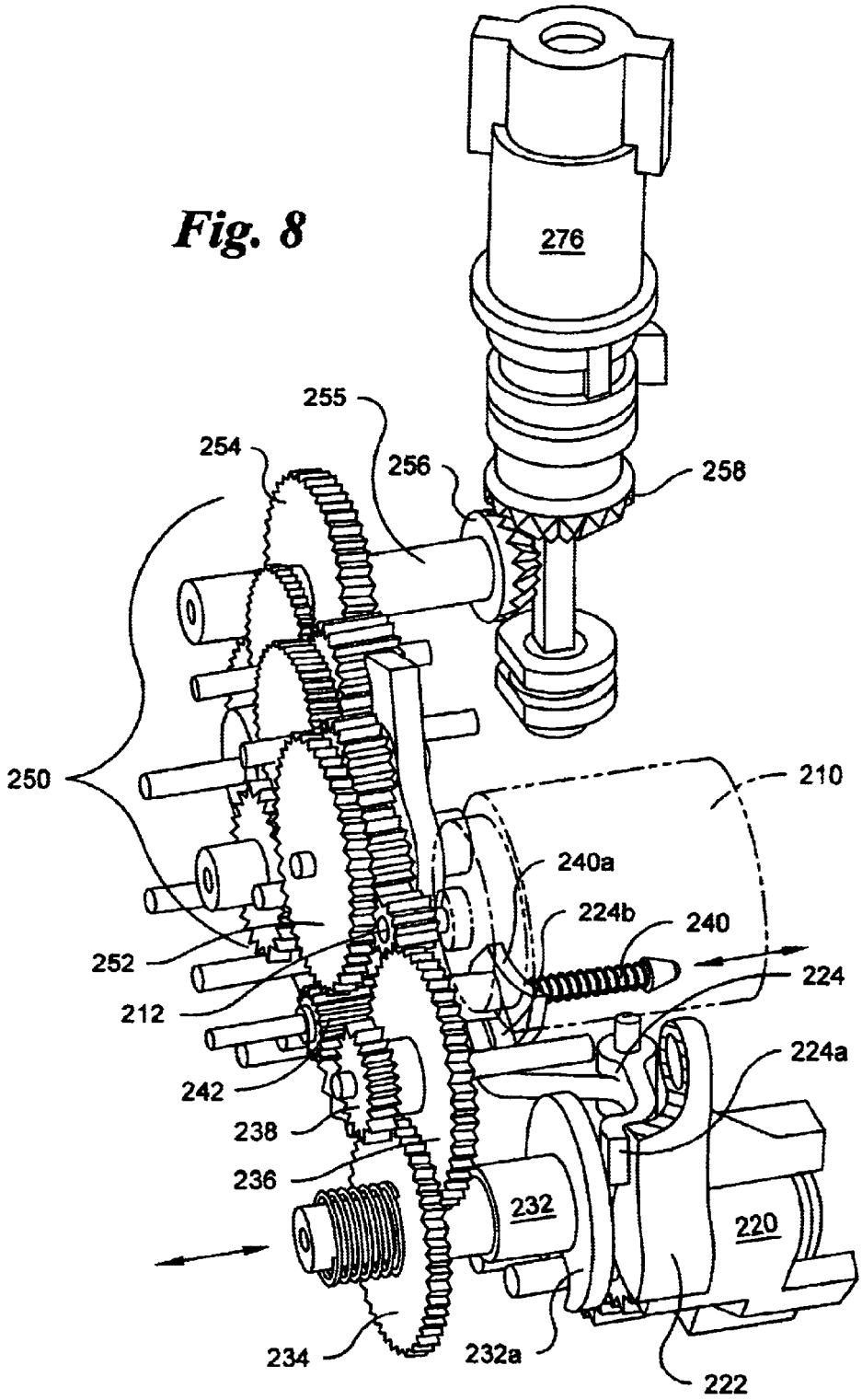
FIG. 8 is an upper rear perspective view of the projectile firing apparatus of FIG. 1 in a state of partial disassembly showing a drive motor (in phantom), a gear drive assembly, and portions of a rotor blade sub-assembly.

Cooperation of the trigger 36 and levers 220, 222, 224 and various gears to fire the projectile will now be described. As indicated above, when the first trigger 36 is moved to the activated position (not illustrated), the cannon 120 is pivoted into the second position 124. In addition to moving the cannon 120, the cammed surface 38 pivots the first lever 220 forward. Second lever 222 is biased into engagement with first lever 220 by a first lever biasing spring 226. With particular reference now to both FIG. 6 and FIG. 8, as first lever 220 rotates counterclockwise (as seen in FIG. 6), second lever 222 is also rotated counterclockwise, pivoting second lever 222 forward into engagement with third lever 224. Forward movement of the second lever 222 causes the third lever 224 to pivot. As third lever 224 pivots, a first portion 224*a* is pushed into engagement with a disk 232*a* fixedly attached to first movable shaft 232. Shaft 232 is capable of side to side translation. AS indicated above, first movable gear 230 is mounted to a first end of shaft 232. A second movable gear 234 is attached to a second end of shaft 232. As first portion 224*a* pushes shaft 232 to the left (as seen in FIG. 8), second movable gear 234 is moved into engagement with combination gear pinion 238. As combination gear pinion 238 is in operative engagement with the drive motor 210 via motor pinion 212 and combination gear 236, engagement of second movable gear 234 with combination gear pinion 238 serves to operatively couple first movable gear 230 with the drive motor 210.

With the first movable gear 230 operatively engaged with the drive motor 210, the firing ram input gear 162 can be driven for rotation via firing ram upper output gear 228. In turn, firing ram drive gear 164 can be driven for rotation by firing ram input gear 162 via firing ram gear train 168.

As discussed above, as firing ram drive gear 164 rotates, firing ram drive gear pins 166 rotate into and out of engagement with the forward edge 144*a* of the firing ram arm 144, first pulling the firing ram 144 back against spring 148, and then with continued rotation abruptly releasing firing ram 144. Firing ram 144 strikes the projectile 100 disposed within the cannon 120, firing the projectile, 100 from the cannon 120. As is also discussed above, simultaneous with rearward movement of the firing ram 144, the loading ram 152 moves forward to block movement into the firing position by any projectile 100 disposed at the cannon inlet 130.

FIG. 8 further illustrates a rotor drive gear train 250 which operatively connects the drive motor 210 to the rotor blade sub-assembly 270. In the position illustrated in FIG. 8, a third movable gear 242 is operatively engaged with combination gear 236. Third movable gear 242 operatively engages the rotor drive gear train 250 to drive a right angle bevel gear set, having an input bevel gear 256 and an output bevel gear 258. Rotor drive gear train 250 includes a rotor drive input gear 252 and a rotor drive output gear 254. Rotor drive output gear 254 is fixedly attached to rotor drive shaft 255. Input bevel gear 256 is also fixedly attached to rotor drive shaft 255, and thus input bevel gear 256 rotates with rotor drive output gear 254. Output bevel gear 258 is fixedly attached to the rotor shaft 276, with the rotor blade hub 274 in turn being attached to the rotor shaft 276. Thus, when third movable gear 242 is operatively engaged with combination gear 236, the rotor blades 272 are operatively engaged with the drive motor 210.

The third lever 224 comprises not only the first portion 224*a* but also a second portion 224*b*. When the third lever 224 is pivoted under the action of first trigger 36 via first and second levers 220 and 222, not only does the first portion 224*a* move the second movable gear 234 into operative engagement with the drive motor 210, but the second portion 224*b* moves the third movable gear 242 out of operative engagement with the drive motor 210. With reference to FIG. 8, third movable gear 242 is mounted on a second translating shaft 240 which is operatively coupled with second portion 224*b*. When the third lever 224 is pivoted by the first trigger 36, second translating shaft 240 is moved to the right (as seen in FIG. 8) by the second portion 224*b* pushing against member 240*a*, pulling third movable gear 242 out of engagement with drive gear 236. Thus, when the firing mechanism is operatively engaged with the drive motor 210, the rotor drive mechanism is operatively disengaged from the drive motor 210, and vice versa.

Figure 9:
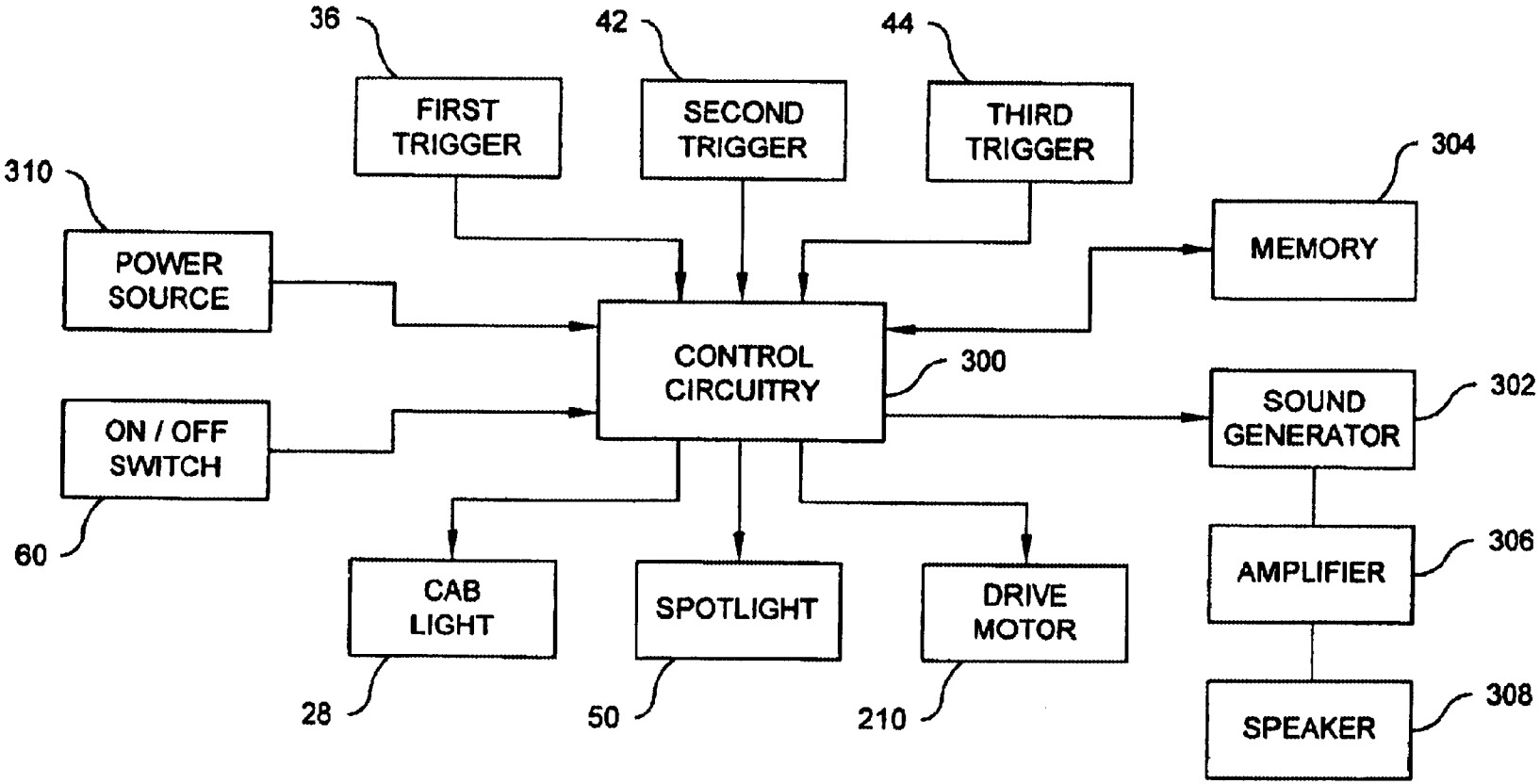
FIG. 9 is a block diagram showing electrical components of the projectile firing apparatus of FIG. 1.

FIG. 9 illustrates electrical components of the projectile shooting toy 10. The control circuitry 300 is operatively connected to the first, second and third triggers via switches represented schematically by boxes 36, 42 and 44, respectively. The control circuitry 300 is further operatively connected to the power source 310, an on/off switch 60, drive motor 210, cab light 28, spotlight 50, memory 304, and sound generator 302. An amplifier 306 and the speaker 308 are in turn operatively connected to the sound generator 302.

Optionally, the projectile shooting toy 10 may include a pop-up door feature (not illustrated). In one embodiment, the pop-up door sub-assembly includes a side door (not illustrated) pivotably attached to the left body housing 24. A figurine (not illustrated) may be attached to the side door. A side door spring (not illustrated) biases the side door into a stored (normally closed) position. The side door may be operably coupled to the drive motor 210 for example, through a cam, to allow the side door be pivoted outwardly into an open position.

A preferred embodiment of the toy helicopter 12 provides three major operational modes. In the first mode, the user squeezes the first trigger 36 to initiate deployment of the cannon 120 into the second position 24, firing of the projectile 100, announcement of various recorded messages through the speaker 308 and illumination of the spotlight 50 and the cockpit light 28. In the second mode, the user squeezes the second trigger 42 to initiate movement of the rotor blades 272, and, if a pop-up side door is provided, deployment of the side door into the side door deployed position, announcement of various recorded messages through the speaker 308 and illumination of the spotlight 50 and the cockpit light 28. In the third mode, the user squeezes the third trigger 44 to initiate announcement of various recorded messages and illumination of the spotlight 50 and the cockpit light 28.

The toy helicopter 12 may also function in a "Try Me" mode, intended for use prior to purchase when the toy helicopter 12 is still in a retail package (not shown). In the"Try Me" mode, operation of the first trigger 36 causes the cannon 120 to move from the retracted position 22 to the deployed position 24. The projectile 100 is not capable of being launched when the toy helicopter 12 is in the "Try Me" mode. In addition to deployment of the cannon 120, recordings are announced via the speaker 308 and the cockpit light 28 is illuminated. Operation of the second trigger 42 in the "Try Me" mode may cause the side door, if provided, to move to its deployed position. Further, the rotor blades 272 may be caused to move in an oscillatory manner.

The projectile shooting toy 10 can be constructed of, for example, polymeric materials or any other suitable material such as metal or composite materials using conventional fabrication techniques well known to those skilled in the art. From this disclosure, it would be obvious to one skilled in the art to vary the dimensions of the toy helicopter 12 shown, for example making components of the toy helicopter 12 smaller or larger relative to the other components.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention.

We claim:

1. A projectile shooting toy comprising:

a body housing;

a drive motor supported by the body housing;

an operating trigger having a first unactivated position and a second activated position;

control circuitry operably coupled to the operating trigger and the drive motor wherein the control circuitry activates the drive motor when the operating trigger is moved to the second position; and a projectile firing apparatus, including:

a projectile cannon mounted on the body housing and having:

a cannon housing having an inlet at a first end and an outlet at a second end, a firing ram operably coupled to the motor, and a projectile retaining flap disposed within the projectile cannon, the projectile retaining flap being movable between a first retaining position and a second release position and being biased into the retaining position by a spring.

2. The projectile shooting toy of claim 1, wherein movement of the trigger to the activated position causes the drive motor to move the firing ram from a first position to a second position and then abruptly release the firing ram to return to the first position, thereby striking any projectile held in the cannon housing by the projectile retaining flap in the first retaining position and shoot the projectile from the cannon housing, the projectile retaining flap being momentarily moved into the release position by the shot projectile.

3. The projectile shooting toy of claim 1, further comprising an interior portion forming a projectile delivery tube.

4. The projectile shooting toy of claim 3 wherein:

the projectile delivery tube has an inlet disposed on an upper portion of the body housing;

the operating trigger includes a cammed surface;

the projectile cannon is pivotally mounted on the body housing and has a first stored position and a second deployed position; and movement of the trigger to the activated position causes the projectile cannon to pivot from the stored position to the deployed position under action of the cammed surface allowing the projectile to move from the projectile delivery tube into the inlet of the cannon housing.

5. The projectile shooting toy of claim 4 further comprising a loading ram disposed adjacent the cannon housing inlet and operably coupled to the drive motor, the motion of loading ram being coupled with the motion of the firing ram to prevent a second projectile disposed in the projectile delivery tube from moving into a firing position during operation of the firing ram.

6. The projectile shooting toy of claim 1 further comprising an electric power source supported by the body housing, wherein the drive motor receives power from the electric power source.

7. The projectile shooting toy of claim 6 further comprising:

a sound generator operably coupled to the control circuitry;

a memory operably coupled to the control circuitry;

an amplifier operably coupled to the sound generator;

a speaker operably coupled to the amplifier, wherein when the trigger is moved to the activated position, the control circuitry selects from the memory stored data corresponding to a sound passage and causes the sound passage to be audiblized via the speaker.

8. The projectile shooting toy of claim 6 further comprising at least one light operably coupled to the control circuitry and receiving power from the electric power source.

9. The projectile shooting toy of claim 8 wherein the control circuitry causes the at least one light to be illuminated when the trigger is moved to the activated position.

10. The projectile shooting toy of claim 1 further comprising a movably mounted element and a power transmission operably coupling the drive motor and the movably mounted element.

11. The projectile shooting toy of claim 1 wherein the toy is a vehicle.

12. The projectile shooting toy of claim 11 wherein the toy is a helicopter.

13. The projectile shooting toy of claim 12 further comprising a movably mounted element and a power transmission operably coupling the drive motor and the movably mounted element wherein the movably mounted element is a rotor assembly.

14. A projectile shooting toy comprising:

a body housing;

a drive motor supported by the body housing;

control circuitry operably coupled to the drive motor;

a first trigger operably coupled to the control circuitry;

a second trigger operably coupled to the control circuitry;

a projectile firing apparatus, including:

a projectile cannon mounted on the body housing and having:

a cannon housing having an inlet at a first end and an outlet at a second end, and a firing ram operably coupled to the motor; and a movably mounted element and a power transmission operably coupling the drive motor and the movably mounted element;

wherein activation of the first trigger causes the control circuitry to activate the drive motor to move the firing ram from a first position to a second position and then abruptly release the firing ram to return to the first position, thereby striking any projectile held in the cannon housing, and wherein activation of the second trigger causes the power transmission to drive the movably mounted element.

15. The projectile shooting toy of claim 14, wherein the toy is a helicopter.

16. The projectile shooting toy of claim 15, wherein the movably mounted element is a rotor assembly.

17. The projectile shooting toy of claim 14, further comprising a third trigger.

18. The projectile shooting toy of claim 17, further comprising:

at least one light;

a sound generator operably coupled to the control circuitry;

a memory operably coupled to the control circuitry;

an amplifier operably coupled to the sound generator;

a speaker operably coupled to the amplifier, wherein when the third trigger is activated, the control circuitry selects from the memory stored data corresponding to a sound passage and causes the sound passage to be audiblized via the speaker and also causes the at least one light to be illuminated.

* * * * *